US005390444A

United States Patent [19]

Simonin et al.

[11] Patent Number: 5,390,444

[45] Date of Patent: Feb. 21, 1995

[54] BARRIER DEVICE FOR CONTROLLING A PASSAGE FOR PEDESTRIANS, THE DEVICE BEING OF THE THREE-LEGGED TURNSTILE TYPE

[75] Inventors: Marcel Simonin, Bretigny sur Orge; Bernard Garbe, Lardy, both of France

[73] Assignee: Compagnie Generale d'Automatisme CGA-HBS, Bretigny sur Orge, France

[21] Appl. No.: 140,395

[22] Filed: Oct. 25, 1993

[30] Foreign Application Priority Data

Oct. 26, 1992 [FR] France ..... 92 12725

[51] Int. Cl.[6] ..... E06B 11/08

[52] U.S. Cl. ..... 49/47

[58] Field of Search ..... 49/35, 46, 47, 49

[56] References Cited

U.S. PATENT DOCUMENTS

| | | | |
|---|---|---|---|
| D. 188,190 | 6/1960 | Stevens | 49/49 X |
| D. 188,191 | 6/1960 | Stevens | 49/46 X |
| 560,386 | 5/1896 | Williams | 49/46 X |
| 1,307,317 | 6/1919 | Perey | 49/46 |
| 1,646,078 | 10/1927 | Bacon . | |
| 2,309,893 | 2/1943 | Gersbach | 49/46 |
| 4,640,047 | 2/1987 | Simonin et al. | 49/47 |

FOREIGN PATENT DOCUMENTS 2591371 6/1987 France .

*Primary Examiner*—Jerry Redman

*Attorney, Agent, or Firm*—Sughrue, Mion, Zinn, Macpeak & Seas; Richard C. Turner, Anirma Rakshpal

[57] ABSTRACT

A barrier device for controlling a passage for pedestrians, the device being of the three-legged turnstile type comprising a rotary hub whose axis is inclined at about 45° relative to the vertical, and which has three legs fixed thereto that successively take up position across said passage on each rotation through one-third of a turn each time a pedestrian passes through, the bottom edge of a leg in its passage-barring position substantially constituting a horizontal straight line, wherein each leg, when seen in its passage-barring position, occupies a substantially vertical plane over a height that lies in the range 150 mm to 300 mm, at least towards the middle of the leg.

2 Claims, 1 Drawing Sheet

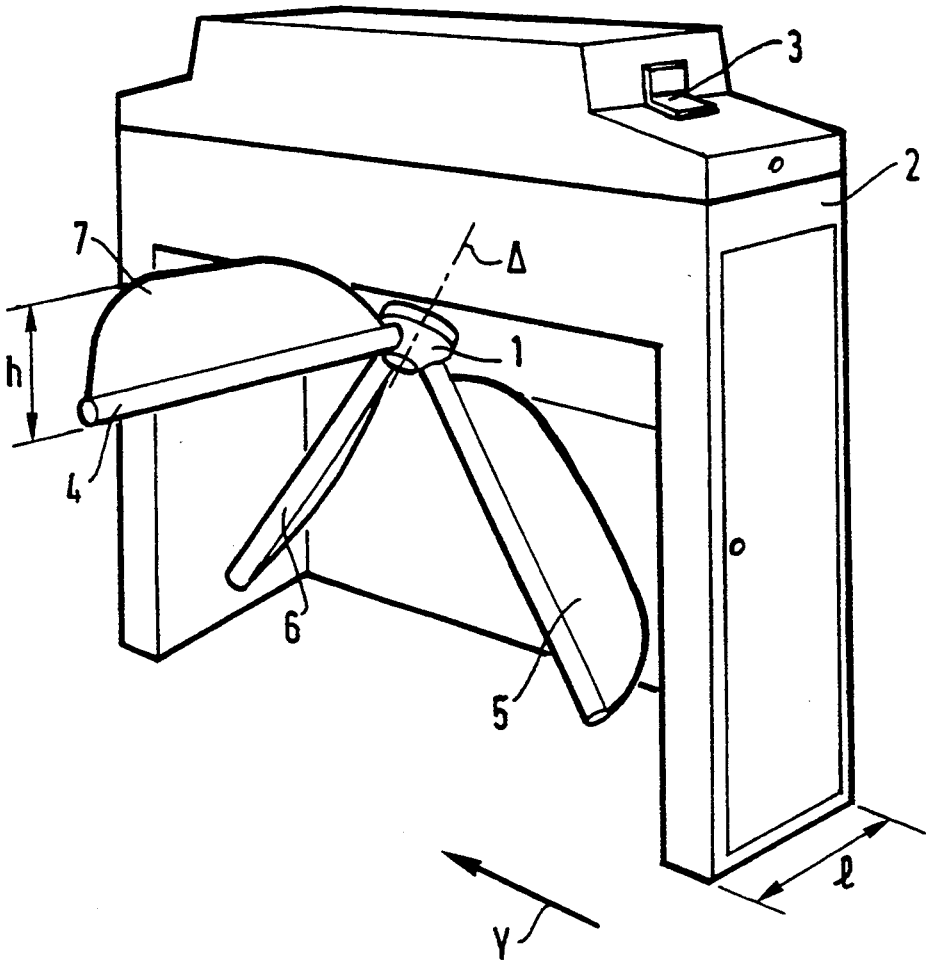
3
2
7
Δ
h
1
4
6
5
ℓ
Y

BARRIER DEVICE FOR CONTROLLING A PASSAGE FOR PEDESTRIANS, THE DEVICE BEING OF THE THREE-LEGGED TURNSTILE TYPE

The present invention relates to a barrier device for controlling a passage for pedestrians, the device being of the three-legged turnstile type.

BACKGROUND OF THE INVENTION

Barriers of this type are in widespread use, for example in the Paris subway. Such a barrier has three legs fixed to a hub whose axis of rotation is at about 45° to the vertical.

One of the legs takes up a horizontal position obstructing a passage while the other two are in a retracted position within the thickness of the turnstile stand. Normally the support hub is prevented from rotating, thereby preventing non-authorized users from passing. However, a user may be allowed to pass by unlocking rotation of the leg-supporting hub, releasing the turnstile to rotate through one-third of a turn each time a user passes, generally after the user has been recognized by an agent or after a pass has been recognized automatically.

In general, the hub supporting the three legs is mounted on the stand so that the horizontal leg obstructs the passage at a height of about 800 mm above the ground. This type of barrier suffers from the defect of being easy to get past, either by ducking under the leg or by jumping over it, if necessary by taking a purchase on the two stands on either side of the passage.

OBJECTS AND SUMMARY OF THE INVENTION

An object of the present invention is to make this type of fraud more difficult, and it thus provides a barrier device for controlling a passage for pedestrians, the device being of the three-legged turnstile type comprising a rotary hub whose axis is inclined at about 45° relative to the vertical, and which has three legs fixed thereto that successively take up position across said passage on each rotation through one-third of a turn each time a pedestrian passes through, the bottom edge of a leg in its passage-barring position substantially constituting a horizontal straight line, wherein each leg, when seen in its passage-barring position, occupies a substantially vertical plane over a height that lies in the range 150 mm to 300 mm, at least towards the middle of the leg.

Advantageously, the bottom of each leg in its passage-barring position is at a height above the ground lying in the range 650 mm to 750 mm.

A BRIEF DESCRIPTION OF THE DRAWING

The sole FIGURE shows a three-legged turnstile having an integrally attached barrier on each leg which extends vertically when in the passage-barring position.

DETAILED DESCRIPTION OF THE DRAWING

The invention is now described with reference to the sole FIGURE of the accompanying drawing.

The FIGURE thus shows a barrier device of the invention for controlled passage of pedestrians, the device being of the three-legged turnstile type. This type of barrier is well known and comprises a rotary hub 1 whose axis Δ extends at an angle of substantially 45° relative to the vertical. The hub is fixed to a stand 2 which contains all of the mechanism and the electrical equipment for controlling the turnstile and for processing a pass inserted by a user into a slot 3.

Rotation of the rotary hub 1 is normally prevented, and it is enabled for one-third of a turn only on a valid pass being recognized.

Three legs 4, 5, and 6 are fixed on the hub 1. On each third of a turn, the legs successively take up a position in which they extend across the passage. In the FIGURE, it is the leg 4 that is shown barring the passage. After a pedestrian has gone through in the direction Y by pushing against the leg 4, it is the leg 5 that takes up position for barring the passage, and so on.

In the known prior art, the legs are simple cylindrical rods having a diameter of 40 mm to 50 mm, and the leg that bars the passage occupies a horizontal position at a height of about 800 mm above the ground.

According to the invention, each leg, when in its passage-barring position, such as the leg 4 in the FIGURE, occupies a much greater height h in a vertical plane. This height h may lie in the range 150 mm to 300 mm, at least towards the middle of the leg. The available height h is determined by the width 1 of the stand 2. When the turnstile rotates, it is essential to ensure that none of the legs overlaps an adjacent passage, yet during rotation, each leg occupies a vertical plane perpendicular to the direction Y of the passage on two occasions: a first time when the leg is in the same position as the leg 4 in the FIGURE; and a second time when that leg has been rotated through 180° by the hub 1. In this second position, the height h extends across the width 1 of the stand 2. It can thus be seen that the height h must be less than the width 1 of the stand. For a stand having a width 1 of 300 mm, the height h may lie in the range 200 mm to 250 mm, for example. To obtain a height h of 300 mm, it is necessary for the stand to be at least 350 mm wide.

This increase in height h relative to the 40 mm to 50 mm diameter of a simple rod in the prior art also makes it possible to a certain extent to lower the level at which the hub 1 is fixed. It can be lowered so that when a leg 4 is in the passage-barring position, it has its bottom edge at a height lying in the range 650 mm to 750 mm, for example.

Thus, for a stand of width 1=300 mm, it is possible to use a leg of height h=250 mm, and to place it so that its bottom edge is 700 mm above the ground, thereby providing a barrier that extends over a height h=250 mm from 700 mm above the ground to 950 mm above the ground. This makes fraudulent passage more difficult.

By way of example, each leg may be constituted by a conventional leg comprising a cylindrical rod and that has a bow-shaped member fitted thereto. Alternatively, it is possible to use a solid panel 7.

We claim:

1. A barrier device for controlling a passage for pedestrians, comprising; a three-legged turnstile comprising a rotary hub whose axis is inclined at about 45° relative to the vertical, three unitary legs fixed to said rotary hub for successively taking up position across said passage on each rotation through one-third of a turn each time a pedestrian passes through said turnstile, a bottom edge of each leg, when located in its passage-barring position, extending substantially horizontally, and each said leg, when located in its passage-barring position, occupying a substantially vertical space spanning 150 mm to 300 mm at at least a middle portion of said leg.

2. A device according to claim 1, wherein the bottom edge of each leg in its passage-barring position is located at a height above the ground lying in the range 650 mm to 750 mm.

* * * * *